United States Patent [19]

Kummer

[11] Patent Number: 4,848,039

[45] Date of Patent: Jul. 18, 1989

[54] METHOD AND APPARATUS FOR GRINDING MULTIPLE WORKPIECES

[76] Inventor: Kenneth L. Kummer, 105 E. Foster Ave., Roselle, Ill. 60172

[21] Appl. No.: 57,363

[22] Filed: Jun. 2, 1987

Related U.S. Application Data

[62] Division of Ser. No. 702,363, Feb. 15, 1985, Pat. No. 4,672,775.

[51] Int. Cl.[4] ..... B24B 1/00

[52] U.S. Cl. ..... 51/281 R; 51/327; 51/77 R; 51/230; 51/215 CP

[58] Field of Search ..... 51/281 R, 281 SF, 74 R, 51/74 BS, 77 R, 77 BS, 72 R, 230, 215 CP, 326, 327

[56] References Cited

U.S. PATENT DOCUMENTS

| | | | |
|---|---|---|---|
| 817,798 | 4/1906 | Peirce . | |
| 1,046,801 | 12/1912 | Kelder | 51/77 R |
| 1,548,562 | 8/1925 | Spencer . | |
| 1,847,577 | 3/1932 | Thompson | 51/217 R |
| 1,916,917 | 7/1933 | Booth . | |
| 1,991,724 | 2/1935 | Binns et al. . | |
| 2,804,727 | 9/1957 | Schmidt . | |
| 3,019,564 | 2/1962 | Haracz . | |
| 3,805,456 | 4/1974 | Williams . | |
| 3,925,878 | 12/1975 | Kikuchi . | |
| 3,945,153 | 3/1976 | Williams . | |
| 4,030,252 | 6/1977 | Price . | |
| 4,551,902 | 11/1985 | Thibaut . | |

FOREIGN PATENT DOCUMENTS

| | | | |
|---|---|---|---|
| 0333404 | 11/1958 | Switzerland | 51/74 |
| 0590713 | 8/1977 | Switzerland | 51/74 R |

OTHER PUBLICATIONS

Brochure: Ex-Cell-O 85 CNC Twin Wheel Precision Form Grinder.
Catalog: Shoyei Belt Grinder.
Catalog: Williams Thru-Feed Grinding (Speedram).
Catalog: Williams Thru-Feed Grinding (Speedfam).
Catalog: Thru-Feed Grinding (Speedfam).
Catalog: Elb.
Catalog: Surface Grinders (GMN).
Catalog: Muller-Precision-Rotary Table Surface Grinder MPS-R600 (GMN).
Two-Page Bulletin: New Model 84 Rotary Grinder (Mattison Machine Works).
Brochure: Design With an Eye on the Future (Mattison Machine Works).
Brochure: Abrasive Machining (Mattison Machine Works).
Book: 1984 Machine and Tool Directory, p. 180 (a Hitchcock Publication, 31st Edition).

*Primary Examiner*—Frederick R. Schmidt
*Assistant Examiner*—Robert A. Rose
*Attorney, Agent, or Firm*—Dressler, Goldsmith, Shore, Sutker & Milnamow

[57] ABSTRACT

A method and apparatus are provided for effecting high production rate grinding of a plurality of workpieces on a grinding wheel rotating about an axis with reduced power consumption. Each workpiece is mounted in a holding fixture adjacent the grinding wheel to expose a face of the workpiece to be ground. The fixtures are positioned at spaced locations around the periphery of the grinding wheel whereby a grinding station is defined at each location. In one embodiment of the invention, one workpiece at a time is ground, but the grinding of a workpiece begins substantially simultaneously with the termination of the grinding of the preceding workpiece. The apparatus includes a vertically disposed grinding spindle with a grinding wheel mounted on the spindle driven by a motor which, along with the spindle, has a fixed location within the grinding machine housing. A removable upper spindle support member may be removably mounted to the housing above the grinding wheel.

6 Claims, 3 Drawing Sheets

FIG. 1
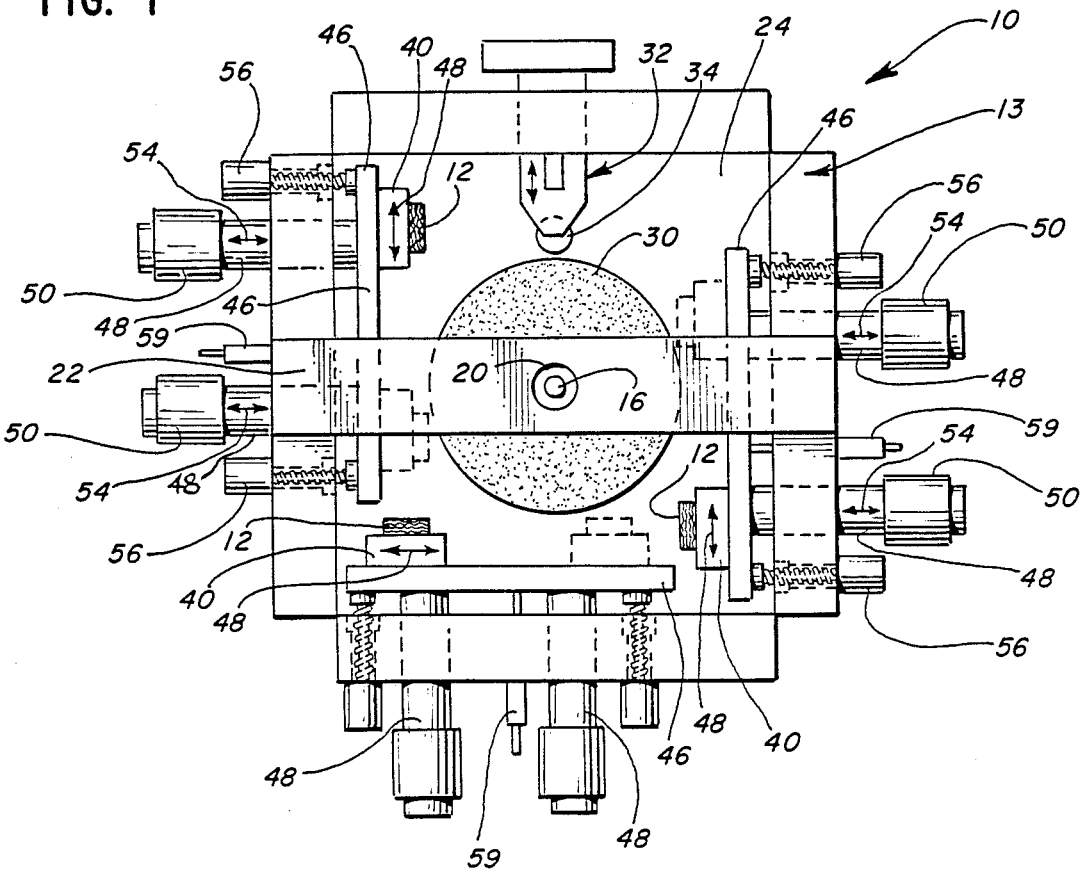
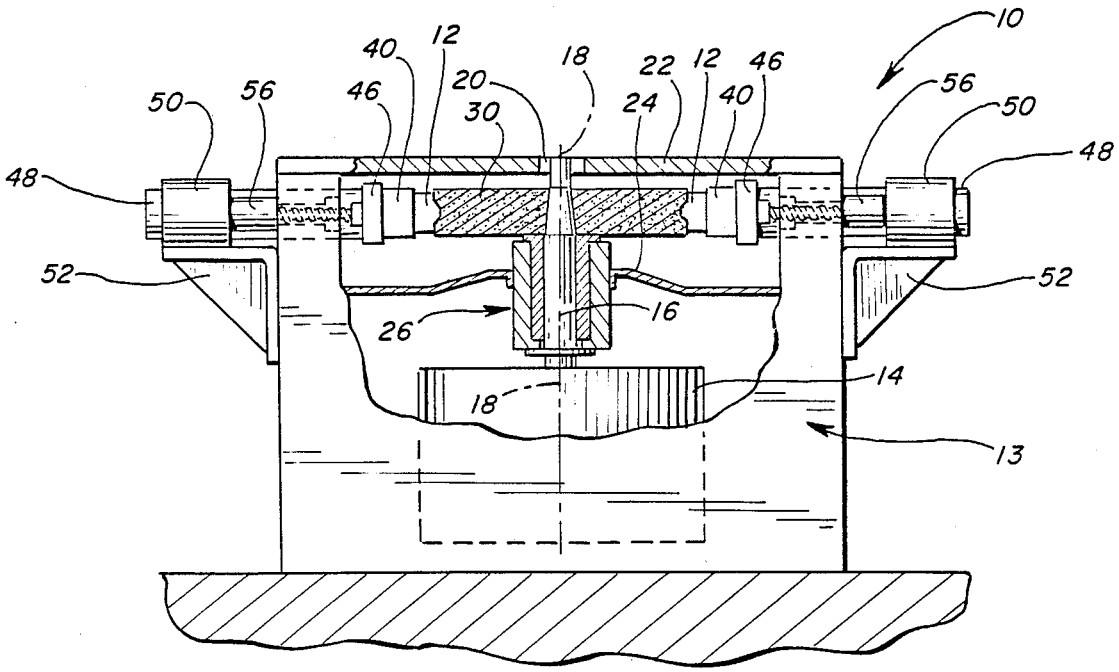
FIG. 2

METHOD AND APPARATUS FOR GRINDING MULTIPLE WORKPIECES

This is a division of application Ser. No. 702,363, filed Feb 15, 1985, now U.S. Pat. No. 4,672,775.

TECHNICAL FIELD

This invention relates to a grinding machine and method for grinding multiple workpieces.

BACKGROUND OF THE INVENTION AND TECHNICAL PROBLEMS POSED BY THE PRIOR ART

Many grinding machines in use today, especially those used to effect the so-called "creep feed" method of grinding, employ a grinding wheel mounted for rotation on a generally horizontally disposed spindle. During the grinding process, the grinding wheel diameter decreases. When these machines are operated to grind workpieces at high stock removal rates and/or with continuous dressing of the grinding wheel, the use of larger diameter grinding wheels and larger motors is usually desired. As the wheel diameter decreases, the entire grinding wheel spindle must be moved vertically downwardly toward the workpiece to continue grinding.

Maintaining tolerances with the larger grinding wheel and drive motor becomes difficult because the machine must accommodate movement of the larger and heavier grinding wheel, spindle, and motor toward and away from the workpiece during the grinding operations.

Such conventional grinding machines also are not particularly suitable for permitting rapid and/or fully automatic replacement of machine components as necessary to accommodate different workpieces.

Also, with most conventional grinding machines having a horizontally disposed grinding spindle, a workpiece is typically ground on a table at a location on the lowest point of the grinding wheel. Typically, it is not feasible or convenient to grind another workpiece until the first workpiece is completely removed and replaced by the new workpiece. Accordingly, the actual grinding of a workpiece does not occur during those periods of time when one workpiece is being removed from the machine and another workpiece is being mounted in the machine. This results in a degree of production inefficiency.

It would be desirable to provide an improved method and apparatus for grinding a plurality of workpieces at high production rates. It would be advantageous if such an improved method and apparatus could efficiently grind a plurality of workpieces while at the same time keeping to a minimum the power required for operating the grinding machine. However, to the extent that it would be desirable to provide a relatively large grinding wheel for effecting higher stock removal rates with or without continuous dressing of the wheel, it would be beneficial if such an improved method and apparatus could accommodate operation within desired machining tolerances and yet permit rapid and/or fully automatic replacement of machine components.

It would also be advantageous to provide an improved grinding method and apparatus which would permit relatively uniform transfer of heat and accommodate thermal expansion with a minimum of deleterious effects. Further, it would be beneficial if such an improved method and apparatus could provide for substantially automated machining, loading, and unloading of workpieces, as well as changing of the grinding wheel.

SUMMARY OF THE INVENTION

A method and apparatus are provided for high production rate grinding of a plurality of workpieces on a grinding wheel rotating about an axis. In one embodiment, each workpiece is mounted in a holding fixture adjacent the grinding wheel to expose a face of each workpiece to be ground. The fixtures are positioned at spaced locations around the periphery of the grinding wheel whereby a grinding station is defined at each location. Next, only one of the workpieces in its fixture is moved in a path against the grinding wheel at a corresponding grinding station so as to grind a face of the one workpiece. After that grinding step, the one workpiece is moved in its fixture toward a location out of contact with the grinding wheel. These last two steps are repeated for each of the remaining workpieces seriatim.

In one embodiment of the apparatus, the apparatus includes control means for sequentially operating the apparatus to move the fixtures (which each contain one workpiece) so that each workpiece is brought into contact with the grinding wheel after a preceding workpiece has been moved out of contact with the grinding wheel.

In another form of the invention, each fixture can be provided with a plurality of workpiece holding clamps arranged one behind the other. A workpiece is mounted in each clamp. One fixture at a time is then sequentially moved against the grinding wheel to grind each of the workpieces seriatim.

In another embodiment, a grinding machine is provided with a housing, a vertically disposed grinding spindle, a spindle motor, a grinding wheel mounted on the spindle, a removable upper spindle support member removably mounted to the housing above the grinding wheel, and a bearing mounted in the upper spindle support member and engaged with the spindle above the grinding wheel. This embodiment of the apparatus will accommodate a number of unique grinding methods wherein a plurality of workpieces may be ground either sequentially or simultaneously.

In still other embodiments of the invention, a handling system is provided for substantially automatically changing the grinding wheel. This includes a gantry, a carriage mounted on the gantry, a positioning means mounted on the carriage, and a gripper means on the positioning means for gripping objects.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same, FIG. 1 is a simplified, top plan view of a first embodiment of a grinding apparatus or machine for operating in accordance with the teachings of the present inventions;

FIG. 2 is a simplified, diagrammatic, sized elevational view of the machine illustrated in FIG. 1 with exterior portions broken away to better illustrate interior detail;

DESCRIPTION OF THE PREFERRED EMBODIMENTS

Figure 3:
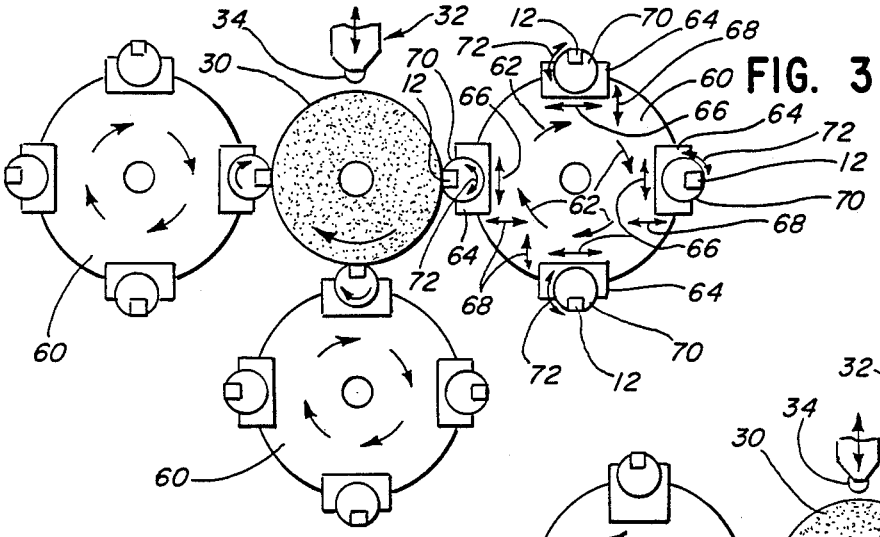
FIGS. 3–6 are each simplified, diagrammatic top plan views of second through fifth embodiments, respectively, of the grinding machine.

While this invention is subsceptible of embodiment in many different forms, this specification and the accompanying drawings disclose only some specific forms of the apparatus and method as an example of the use of the invention. The invention is not intended to be limited to the forms so illustrated, and the scope of the invention will be pointed out in the appended claims.

For ease of description, the apparatus of this invention is described in a normal, operating position, and terms such as upper, lower, horizontal, etc. are used with reference to this position. It will be understood, however, that the apparatus of this invention may be manufactured, stored, and sold in an orientation other than the position described.

The apparatus of this invention has certain conventional components, drive mechanisms, and control mechanisms, the details of which, although not fully illustrated or described, will be apparent to those having skill in the art and an understanding of the necessary functions of such components and mechanisms.

A first embodiment of the present invention is illustrated in simplified diagrammatic form in FIGS. 1 and 2. The embodiment of the apparatus is a single grinding machine 10 which is designed for operating according to one form of the method of the present invention to efficiently grind a plurality of workpieces 12.

The grinding machine 10 includes a housing 13 in which is mounted a motor 14. A grinding wheel spindle 16 is provided to be driven by the motor 14 and is generally vertically disposed within the housing 13. The spindle 16 may be directly engaged with the motor 14 for rotation about a vertical axis 18 (FIG. 2). On the other hand, if desired, a suitable gear drive assembly (not illustrated) may be operatively interposed between the motor 14 and the spindle 16.

The upper end of the spindle 16, in the preferred embodiment illustrated in FIGS. 1 and 2, is supported for rotation in a bearing 20 mounted in an upper spindle support member 22. The upper spindle support member 22 is preferably separable from, and removable from, the housing 13. The removable member 22 is normally secured with appropriate fastening means (e.g., hinge mechanisms, hydraulic clamping and moving mechanisms, or bolts (not illustrated)) to insure a generally rigid assembly which, when desired, can be relatively easily disassembled or operated to remove the member 22.

Covering the motor 14 and a portion of the spindle 16 is an upper enclosure member 24. The enclosure member 24 extends across the interior of the housing 13 and shields the motor 14, as well as a lower interior portion of the housing 13, from grinding particles and coolant.

A lower, main bearing 26 is provided around the lower portion of the spindle 16 and may be mounted in proper alignment about the spindle 16 by means of a suitable framework such as, but not limited to, the enclosure member 24.

A grinding wheel 30, with an integral hub, is mounted on the spindle 16 for rotation with the spindle 16. The grinding wheel 30 is horizontally disposed and defines a peripheral grinding surface which may be cylindrical or which may have a specific profile for grinding a particular surface configuration in the workpieces 12.

The grinding wheel 30 may be dressed as desired, either continuously or intermittently, by a suitable conventional dressing tool 32 (FIG. 1) mounted to the housing 13. The dressing tool 32 includes a conventional dressing roll 34 for contacting and shaping the grinding wheel 30.

The dressing tool 32 may be reciprocated, by conventional means not illustrated, toward and away from the grinding wheel 30. The detailed design and specific structure of the dressing tool 32 incorporated in the machine 10 described herein forms no part of the present invention.

A plurality of workpiece holding fixtures 40 are provided adjacent the grinding wheel 30 at spaced locations around the periphery of the grinding wheel 30 whereby a grinding station is defined at each location. In the embodiment illustrated in FIGS. 1 and 2, there are three workpieces holding fixtures 40 around the periphery of the grinding wheel 30. Each workpiece holding fixture 40 may be of a special design or may be of a conventional design, and the present invention is not limited to a specific fixture structure.

Means are provided for moving each workpiece holding fixture 40 in a path adjacent the grinding wheel 30 at the corresponding grinding station so as to grind a face of a workpiece 12 held in the fixture. Specifically, in the embodiment illustrated in FIGS. 1 and 2, each fixture 40 is slidably disposed, in a well-known manner, on a platform 46 in guideways (not visible in the Figures). Conventional, well-known means (not illustrated) are provided for reciprocating each fixture 40 along its associated platform 46 in the directions of the double-headed arrow 48 (FIG. 1). The present invention is not limited by the specific nature of the means for effecting such reciprocation of the fixture 40.

Each platform 46 is mounted on a pair of cylindrical support members or rods 48 which in turn are each slidably disposed in a bearing or guide 50 that is supported on the side of the housing 13 by means of a bracket 52 (FIG. 2). The rods 48 extend through a suitable aperture (not illustrated) in the housing 13 and are movable relative to the housing 13 toward and away from the grinding wheel 30 (in the directions of the double-headed arrows 54). The bearings 50 could also be installed in the housing 13. Further, rods 48 could have any other suitable form instead of the cylindrical form illustrated.

Means are provided for moving each pair of rods 48 (along with the associated platform 46, fixture 40, and workpiece 12) toward and away from the grinding wheel 30. In the embodiment illustrated, this includes, for each platform 46, a pair of motors 56 which each operate through a suitable threaded drive engaged with the platform 46. The threaded drive may be of a special or conventional design. The present invention is not limited to a specific structure of the means for driving the platform 46 toward and away from the grinding wheel 30.

A control means (not visible in the Figures) is provided for operating the above-described fixture moving means (i.e., the means for reciprocating fixture 40 along the platform 46 and for reciprocating platform 46 relative to the housing 13 toward and away from the grinding wheel 30). The control means functions to 1) effect movement of each workpiece holding fixture 40 in a path adjacent the grinding wheel 30 at the corresponding grinding station so as to grind a face of a workpiece 12 held in each fixture 40 and 2) effect movement of each fixture 40 so as to move the workpiece 12 out of contact with the grinding wheel 30 after the workpiece 12 has been ground.

Further, according to one aspect of the method of the present invention, only one of the workpieces 12, in its fixture 40, is moved into contact with the grinding wheel 30 during a given time period. During the grinding process, the one workpiece 12 moves in a path against the grinding wheel to grind a face of the workpiece. Then the workpiece 12 is moved to a position out of contact with the grinding wheel 30 (i.e., past the grinding wheel 30 to the position illustrated in dashed lines in FIG. 1). The same process is repeated sequentially for each of the remaining workpieces 12 seriatim.

Above-described sequential grinding method subjects the grinding wheel 30 to only one workpiece 12 at a time, rather than to a plurality of workpieces simultaneously. This reduces the power needed to operate the grinding wheel 30. That is, if the three workpieces 12 were *simultaneously* ground on the grinding wheel 30, the power requirement of the grinding wheel motor 14 would be increased. Thus, with the above-described sequential grinding method, the motor size can be reduced.

In order to efficiently grind the plurality of workpieces 12, a workpiece 12 is preferably moved into engagement with the rotating grinding wheel 30 substantially simultaneously with the disengagement of a preceding workpiece 12 from the grinding wheel 30. This results in a substantially constant grinding load on the grinding wheel 30. This also results in the grinding wheel 30 being continuously used to effect the grinding of the workpieces 12.

As the grinding of one of the workpieces is completed, that is, as the workpiece 12 moves out of contact with the grinding wheel 30, the ground workpiece 12 can be removed from the workpiece holding fixture 40, and a new workpiece 12 can be inserted in that fixture 40. This can be effected manually or automatically while one or more of the remaining workpieces 12 is being ground.

Modification of The Method And Apparatus

With some workpieces, especially those which are not unduly complex, it could be advantageous to provide each fixture with a plurality of clamping means or clamps (not illustrated) for holding a plurality of workpieces one behind the other. Thus, as each fixture moves past the grinding wheel 30, a plurality of workpieces would be sequentially ground one after the other. If the spacing between each workpiece in the fixture is kept to a minimum, then as soon as one workpiece is moved out of contact with the grinding wheel, the next workpiece in the row in the fixture will be brought into engagement with the grinding wheel. This would result in the grinding wheel being substantially continuously used to effect the grinding of the workpieces.

Alternate Method And Apparatus

Depending upon the size of the workpieces to be ground and upon the thickness of the grinding wheel, it may be desirable in some situations, to grind a plurality of workpieces simultaneously. With the novel embodiment of the apparatus illustrated in FIGS. 1 and 2, the vertical orientation of the spindle and the support of the spindle on each side of the grinding wheel easily accommodate such simultaneous workpiece grinding.

In one form of such a method for grinding workpieces simultaneously with the above-described apparatus, two or more of the fixtures 40 can be simultaneously moved against the grinding wheel 30 beneath the upper support member 22.

In another form of the method for simultaneously grinding workpieces, one or more of the fixtures 40 could be provided with a plurality of clamps or clamping means for holding a plurality of workpieces. Such clamps would be generally vertically aligned in registry parallel with the spindle axis. The fixture can then be moved beneath the upper support member 22 against a grinding wheel of suitable thickness so that all of the workpieces clamped in the fixture will simultaneously engage the grinding wheel. Other similar or identical fixtures around the periphery of the grinding wheel may be moved into engagement with the grinding wheel either sequentially or simultaneously.

In addition to the above-discussed operational advantages of the present invention, it is to be realized that the apparatus of the present invention provides additional benefits. Specifically, the structure of the housing 13, and the relationship of the apparatus elements therein, provide a relatively rigid structure which can accommodate a large (massive) grinding wheel with relatively little deflection. Since the grinding wheel 30 and motor 14 remain stationary, the workpiece 12 (which may typically be much smaller than the large grinding wheel) can be easily moved during the grinding process. The design of the structures for effecting and accommodating such workpiece movement is greatly simplified. Such structures can be built at less cost than conventionally designed structures which must accommodate movement of both the grinding wheel and motor toward and away from a workpiece support table.

Further, the above-described first embodiment of the present invention, in which the grinding spindle is vertically disposed, has other advantages. Specifically, the vertical orientation of the grinding wheel spindle 16 allows easy access to the grinding wheel 30 for purposes of grinding a plurality of workpieces 12 as well as for the purposes of changing the grinding wheel 30 on the spindle 16.

The arrangement of the apparatus 10 also accommodates temperature increases in a way that substantially eliminates or greatly minimizes the effects of such temperature increases. Any thermal expansion in the apparatus 10 tends to be more uniformly distributed throughout the apparatus. This is in contrast with conventional grinding machines of the "column-type" which tends to "open up" with temperature increase.

The apparatus 10 also easily accommodates modular construction. For example, a customer could initially purchase the apparatus 10 with only one grinding station (i.e., one workpiece holding fixture 40 along with the related support and fixture moving mechanisms). Subsequently, further stations could be added to other sides of the apparatus 10 as production increases. Thus, this would eliminate or reduce investment in additional spindles, grinding wheels, and related dressing tools.

Since only the workpieces 12 need be moved relative to the stationary grinding wheel 30, and since only short moving distances from the grinding wheel center line are involved, it is easier to maintain closer tolerances with a conventional positioner 59 (FIG. 1) and electronic feedback system. The actual position of the diamond dressing roll 34 can be related by such a conventional system to the position of individual workpiece holding fixture 40 so as to maintain a constant distance from the true periphery of the grinding wheel 30.

The use of the upper spindle support member 22 provides increased rigidity of the grinding wheel spindle 16. This reduces tooling costs and provides for greater accuracy in machining. The orientation of the upper spindle support member 22 on the apparatus housing 13 accommodates easy removal of the member 22 either manually or fully automatically.

Finally, the design of the apparatus 10 results in a substantial structural enclosure of the grinding wheel 30, main bearing 26, and motor 14. Further, additional enclosing members and splash guards (not illustrated) can be more easily accommodated with this structure so as to permit use of the apparatus 10 with various coolants, such as oils, which are known to generate significant mist. Since the grinding wheel 30 and spindle 16 are only rotatable and not otherwise movable, enclosure of the grinding wheel and spindle is easier, and there is less danger to operators.

Other Embodiments

Other aspects of the present invention relate to capability of the apparatus 10 to be modified for use with a variety of workpiece holding fixtures and mechanisms for moving such fixture relative to the grinding wheel 30. Such modifications are illustrated in FIGS. 3–6. In those Figures, the grinding wheel 30 has been illustrated along with the dressing tool 32. The housing and related structures have been eliminated for convenience of illustration. The embodiment of the workpiece holding fixture moving mechanisms illustrated in FIGS. 1 and 2 has been replaced in FIGS. 3–6 by alternate mechanisms as will be next described.

As illustrated for each of the embodiments in FIGS. 3–6, a plurality of rotary index tables (60 or 60' or 60'' or 60''') may be spaced around the grinding wheel periphery. Such rotary index tables would replace the workpiece holding devices of the first embodiment (FIGS. 1 and 2 components 40, 46, 48, 50, 56 and 59). The housing 13 would be provided with appropriate apertures and framing structures on each side of the housing as necessary to accommodate such rotary table systems.

In the embodiment illustrated in FIG. 3, a rotary index table 60, which may be of conventional or special design, is provided at each work station. Each index table 60 is mounted for rotation adjacent the grinding wheel 30 and includes means for intermittently rotating the index table 60 in either direction of rotation (e.g., in the direction of the arrows 62).

Each index table 60 include one or more slide tables 64 which are each mounted for reciprocating movement relative to the index table 60 in the directions of double-headed arrows 66. Each slide table 64 is also preferably movable, or carries a second slide table (not illustrated) which is movable, in the directions of double-headed arrows 68.

Finally, a suitable workpiece holding fixture 70 is provided on each slide table 64 for holding a workpiece 12. Each fixture 70 may be rotable about a vertical axis (e.g., in the directions of double-headed arrows 72).

The index table 60, slide table 64, and work holder 70 may be moved in the manner described above by suitable mechanisms of conventional or special design. The present invention is not limited to the specific structure of such mechanisms. With the various movement capabilities that have been described, it is possible to bring a workpiece 12 into contact with the grinding wheel 30 and to grind the workpiece 12 to the desired depth. A workpiece 12 may be reciprocated as necessary adjacent grinding wheel 30. In addition, the workpiece 12 can be rotated about an axis parallel to the axis of the grinding wheel 30 by rotating the workpiece holding fixture 70 in either of the directions indicated by the double-headed arrow 72. This permits the grinding of cylindrical workpieces or the grinding of partially cylindrical surfaces on non-cyclindral workpieces.

The embodiment illustrated in FIG. 3 is adapted to handle four workpieces 12 on each of the index tables 60. The embodiment may be easily modified to handle a greater number or lesser number of workpieces 12.

The embodiment illustrated in FIG. 3 is especially adapted for accommodating secondary operations associated with the actual grinding operation. For example, at one of the four locations around the rotary index table 60, the workpiece 12 may be loaded and mounted in the workpiece holding fixture 70. The other locations around the rotary index table 60 may serve as a deburring station, an inspection station, and the grinding station.

Figure 4:
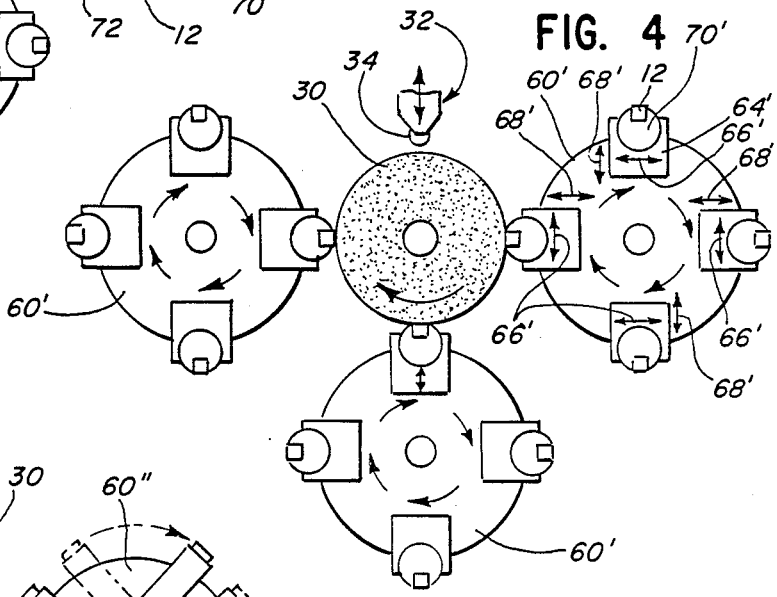

The embodiment illustrated in FIG. 4 is similar to that illustrated in FIG. 3. A rotary index table 60' is provided with slide table 64' and fixtures 70' for holding the workpieces 12. In this embodiment, each slide table 64' is reciprocated relative to the rotary index table 60' at least in the directions of the double-headed arrow 68'. Each workpiece holding fixture 70' is reciprocated in the directions indicated by the double-headed arrow 66' relative to the slide table 64'.

In the embodiments illustrated in FIGS. 3 and 4, the slide tables (64 and 64') may be eliminated altogether if desired. Each rotary index table (60 or 60') would then be provided with appropriate mechanisms for effecting movements of the table per se in the directions indicated by double-headed arrows 66 and 68 or 66' and 68', as necessary.

Figure 5:
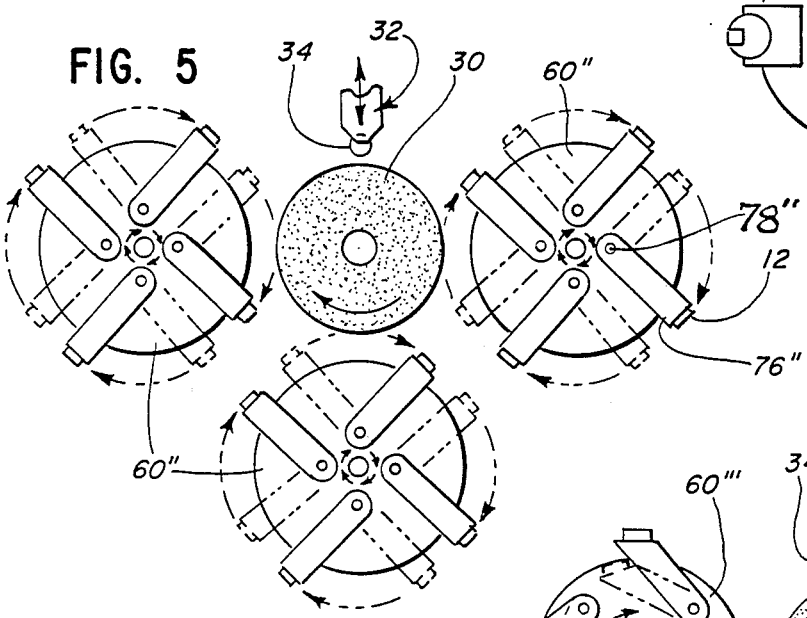

In the embodiment illustrated in FIG. 5, a rotary index table 60'' is provided with a plurality of arms 76''. Each arm 76'' is pivotally mounted to the rotary index table 60'' at a pivot post 78'' Each workpiece 12 is held by a suitable workpiece holding fixture in the end of the arm 76'' Suitable means (not illustrated) are provided for effecting a swinging or pivoting movement of each arm 76'' to cause the workpiece 12 to swing through an arc.

In operation, the rotary index table 60'' is rotated through an angle as necessary to bring one of the arms 76'' into position adjacent to grinding wheel 30. Then the arm 76' is pivoted to swing the workpiece 12 against the grinding wheel 30 to effect the grinding of workpiece 12.

Figure 6:
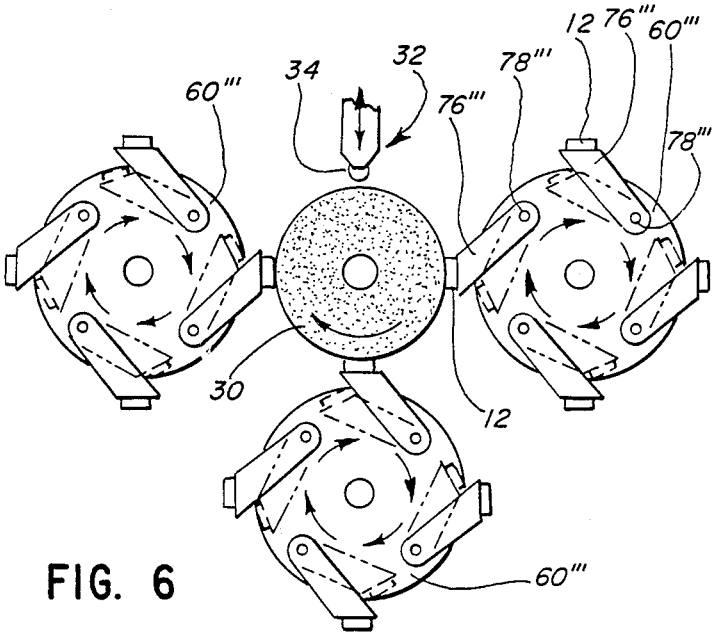

The embodiment illustrated in FIG. 6 is especially adapted for effecting a so-called "plunge cut" or "plunge grind" of a workpiece 12. A rotary index table 60''' is provided with a plurality of arms 76''' which are each pivotally mounted to the index table 60''' about a pivot post 78'''. Conventional means (not illustrated) are provided for pivoting each arm 76''' through an arc. A work holding fixture is provided in the end of each arm 76''' for holding a workpiece 12.

In operation, the rotary index table 60''' is incrementally rotated to an orientation such as that illustrated in FIG. 6. In that orientation, the pivot post 78''' of the arm 76''' adjacent the grinding wheel 30 is displaced from a straight line connecting the axis of rotation of the grinding wheel 30 with the axis of rotation of the rotary index table 60'''. With the table 60''' in this position, the arm 76''' adjacent the grinding wheel 30 is then pivoted outwardly to bring the workpiece 12 into contact with the grinding wheel 30. This effects a plunge cut or plunge grind of the workpiece 12.

Figure 7:
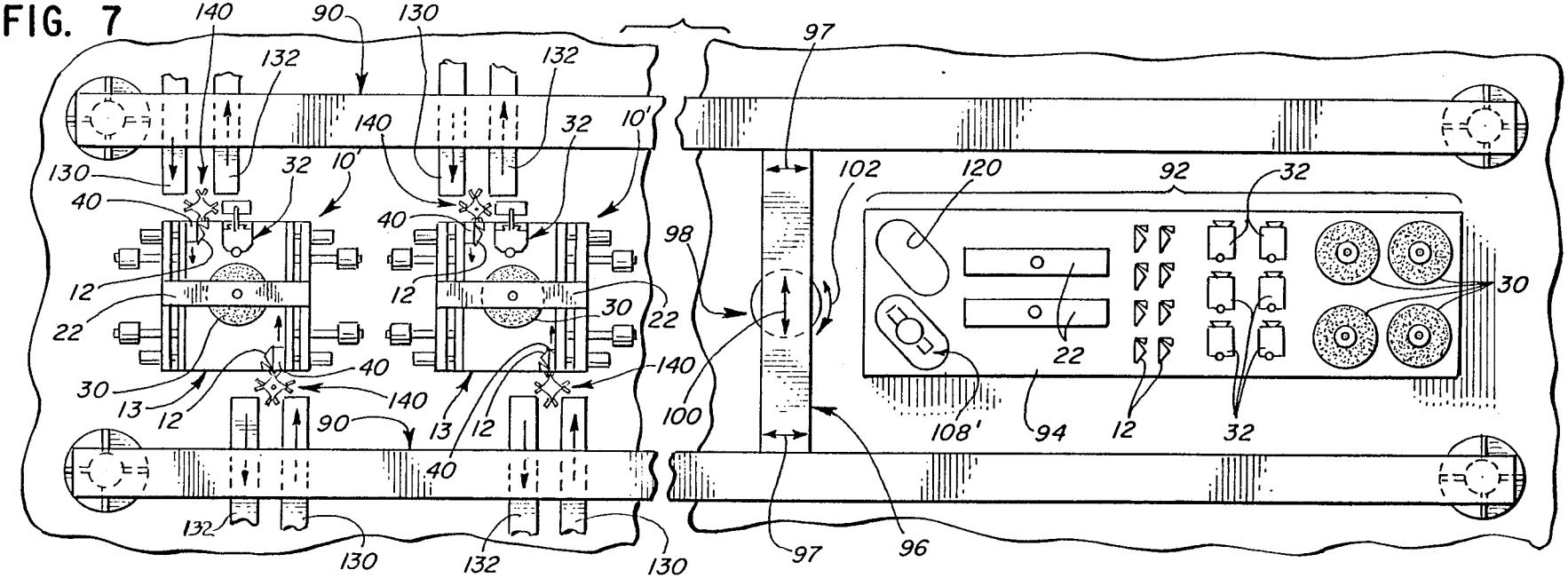
FIG. 7 is a simplified, diagrammatic top plan view of yet another embodiment of the grinding machine which includes a handling system.
Figure 8:
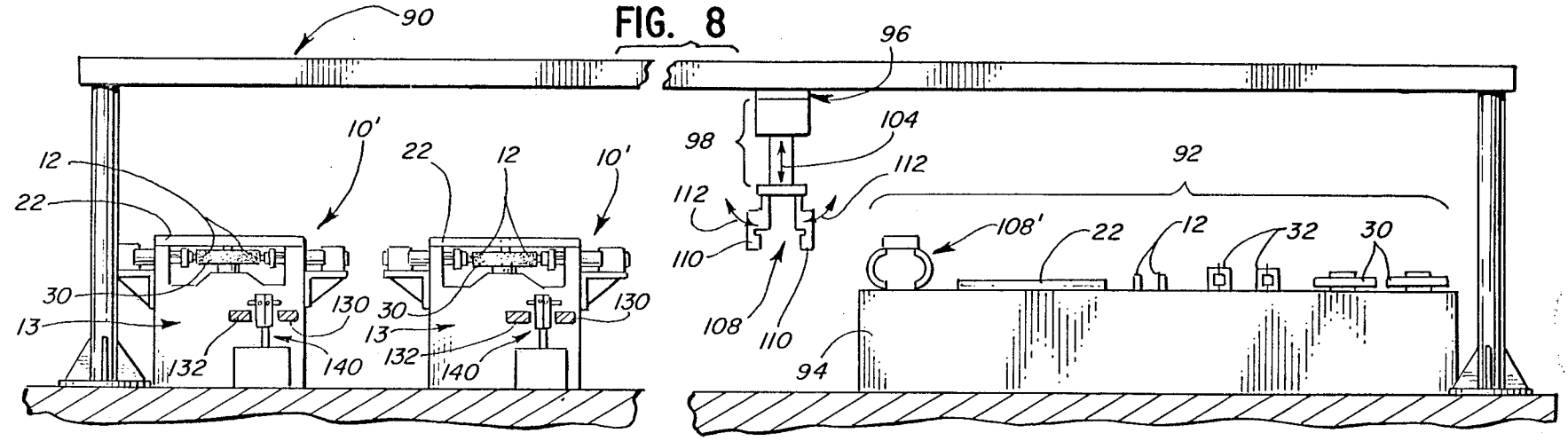
FIG. 8 is a simplified, diagrammatic, side elevational view of the embodiment illustrated in FIG. 7.

Another aspect of the present invention relates to a flexible manufacturing and handling system for accommodating, either fully automatically or with a minimum of manual labor, the loading and unloading of workpieces, as well as the changing of grinding apparatus components. FIG. 7 and 8 diagrammatically illustrate such a system.

A plurality of grinding machines 10' may be provided in such a system. Each grinding machine 10' illustrated in FIGS. 7 and 8 may include the features of the first embodiment of the apparatus 10 described above with reference to FIGS. 1 and 2. However, in the embodiment illustrated in FIGS. 7 and 8, each grinding apparatus 10' is adapted to accommodate two workpieces 12 rather than three.

It is to be realized that the embodiment of the grinding machine 10' illustrated in FIGS. 7 and 8 may be provided with a variety of workpiece holding mechanisms. For example, the rotary index table devices (e.g., as illustrated in FIGS. 3–6) may be used for effecting movement of the workpieces 12 in place of the purely reciprocating devices.

Further, although only two grinding machines 10' are illustrated in FIGS. 7 and 8, it is to be realized that more than two such machines may be provided.

A gantry 90 is provided adjacent the grinding machines 10' and extends adjacent a location which is spaced from the grinding machines 10' and which defines a storage area 92. The storage area 92 may be further defined by the upper surface of a suitable platform 94.

A carriage 96 is mounted for movement along the gantry 90. Also provided is a means (not visible in the Figures) for moving the carriage 96 along the gantry. The movement capability of the carriage 96 along the gantry 90 is illustrated in FIG. 7 by the double-headed arrow 97. Such a carriage moving means may be of any suitable conventional or special design. The present invention is not limited by the specific structure of such a carriage moving means.

A positioning means 98 is provided on the carriage 96 for 1) movement along the carriage 96, 2) rotational movement relative to the carriage 96 about a vertical axis, and 3) reciprocating movement relative to the carriage 96 in a vertical direction. The horizontal movement capability of the positioning means 98 is illustrated in FIG. 7 by the double-headed arrow 100. The rotational movement capability of the positioning means 98 is illustrated in FIG. 7 by the double-headed arrow 102. The reciprocating movement capability of the positioning means 98 is illustrated in FIG. 8 by the double-headed arrow 104.

A gripper means or gripper 108 is provided on the lower end of the positioning means 98. The gripper 108 may have two or more arms 110 adapted for being moved toward and away from each other. Such arms 110 may, for example, be pivotally mounted to the lower end of the positioning means 98 for swinging movement upwardly and downwardly in the directions of the double-headed arrows 112 (FIG. 8). Conventional or special actuating means (not visible in the Figures) may be provided for moving the gripper arms 110. The present invention is not limited to the specific nature of such gripper arms 110 or to the means for effecting operation of such gripper arms 110.

A number of different grippers may be provided. Another type of gripper is designated by reference numeral 108' in FIGS. 7 and 8 where the gripper 108' is shown in a storage position on the platform 94.

When it is desired to change the gripper 108, the carriage 96 is operated to move the positioning means 98 and attached gripper 108 over a vacant storage region 120 (FIG. 7) on the platform 94. The positioning means 98 then lowers the gripper 108 onto the platform 94 where it is disconnected from the positioning means 98, either automatically or manually. Next, the positioning means 98 is moved over the other gripper 108' and engaged therewith.

Various types of gripper mechanisms can be provided to permit the handling system to change the grinding wheels 30 as well as the workpiece holding fixtures 40. Also, the system could be used to change the dressing tool 32. As illustrated in FIGS. 7 and 8, additional grinding wheels 30 and dressing tools 32 may be stored in the storage positions on the platform 94 in the storage area 92. If desired, workpieces 12 may also be stored on the platform 92 before or after machining.

In operation, the system illustrated in FIGS. 7 and 8 can easily change a grinding wheel 30. First, rotation of the grinding wheel 30 on the machine 10' is terminated. Next the carriage 96 and positioning means 98 are operated to engage an appropriate gripper 108 if this has not already been done.

The carriage 96 and positioning means 98 are then moved with the gripper 108 over the grinding wheel 30. If the grinding machine 10' includes a removable upper spindle support member 22 as illustrated for the embodiment in FIGS. 7 and 8, then the member 22 is removed by the gripper (after releasing the fastening devices holding the member 22 to the housing 13 of the grinding machine 10'). The support member 22 is then transported by the carriage 96 and positioning means 98 to the storage area 92 where it is temporarily stored on the platform 94.

Then the gripper 108 is removed and replaced with another gripper suitable for gripping the grinding wheel 30. After removing the spindle nut (not visible in the Figures) from the grinding wheel spindle, the grinding wheel 30 can be gripped by the new gripper and moved to the storage area 92. A new grinding wheel can then be carried from the storage area 92 to the grinding machine 10' and mounted thereon.

Next, the grinding wheel gripper is removed and replaced with the first gripper for the support member 22. The support member 22 is then retrieved from the storage area 92 and mounted back on the grinding machine 10'.

Automated, or substantially automated, handling of the workpieces 12 can also be accommodated. To this end, suitable conventional workpiece infeed mechanisms or conveyors 130 are provided along with suitable conventional workpiece discharge mechanisms or conveyors 132. Between such mechanisms, at each grinding machine apparatus 10', there may be provided a pick and place robot 140 of conventional or special design. Each robot 140 removes a machined workpiece 12 from the workpiece holder 40 and grips a new workpiece 12 from the workpiece infeed mechanism 130. Further operation of the robot 140 causes the machined workpiece 12 to be deposited on the outfeed mechanism 132 and causes the new workpiece to be mounted in the workpiece holder 40.

It is seen that the above-described system illustrated in FIGS. 7 and 8 provides a method and apparatus for substantially automated material handling during production grinding. Further, the system provides great flexibility in use and can efficiently accommodate a plurality of grinding machines.

It will be readily observed from the foregoing detailed description of the invention and the illustrated embodiments thereof that numerous variations and modifications may be effected without departing from the true spirit and scope of the novel concepts or principles of this invention.

what is claimed is:

1. A method for high production rate grinding of a plurality of workpieces on a grinding wheel rotating about an axis with reduced power consumption, said method comprising the steps of:

(A) positioning a plurality of workpiece holding fixtures at circumferentially spaced-apart locations around the periphery of said grinding wheel whereby a grinding station is defined at each said location and mounting in each of said fixtures a group of said workpieces arranged one behind the other in at least one row;

(B) moving one of said fixtures in a path toward a peripheral face of said grinding wheel at the corresponding grinding station to grind a face of each of said workpieces seriatim in the row in said one fixture, said movement being effected in a plane perpendicular to the axis of rotation of said grinding wheel;

(C) after step (B), moving said one fixture to a position to bring the last workpiece in the row out of contact with said grinding wheel; and (D) sequentially effecting steps (B) and (C) for each of the remaining said workpieces in the remaining fixtures of said plurality of fixtures substantially seriatim.

2. The method in accordance with claim 1 in which step (E) includes moving each remaining fixture seriatim to grind an increasing amount of the face of the first workpiece in the remaining fixture row substantially simultaneously with the termination of step (B) as the amount of the last workpiece in the preceding fixture in contact with said grinding wheel decreases.

3. The method in accordance with claim 1 in which step (D) is effected after step (C) is completed.

4. A method for high production rate grinding of a plurality of workpieces on a grinding wheel rotating about an axis, said method comprising the steps of:

(A) mounting said grinding wheel on a vertically disposed spindle and supporting said spindle on each side of said grinding wheel;

(B) positioning a plurality of workpiece holding fixtures circumferentially at spaced-apart location around the periphery of said grinding wheel whereby a grinding station is defined at each said location and mounting in each of said fixtures a group of said workpieces arranged on each fixture in at least one vertically registered column parallel with said spindle axis and adjacent said grinding wheel to expose a face of each workpiece to be ground;

(C) moving one of said fixtures in a path to present each column of said workpieces in said one fixture seriatim against, said movement being effected in a plane perpendicular to the axis of rotation of the grinding wheel said grinding wheel at the corresponding grinding station to simultaneously grind all of the workpieces in one column at a time in said one fixture of said plurality of fixtures;

(D) after step (C), moving said one fixture to a position to bring the workpieces carried thereon out of contact with said grinding wheel; and (E) sequentially effecting steps (C) and (D) for the remaining said workpieces in the remaining fixtures substantially seriatim.

5. The method in accordance with claim 4 in which a plurality of columns of workpieces are mounted in each said fixture and in which step (E) includes moving each remaining fixture seriatim to grind an increasing amount of the faces of the workpiece in the remaining fixture first column substantially simultaneously with the termination of step (C) as the amount of each of the workpieces in the last column in the preceding fixture in contact with said grinding wheel decreases.

6. The method in accordance with claim 4 in which step (E) is effected after step (D) is completed.

* * * * *

UNITED STATES PATENT AND TRADEMARK OFFICE

CERTIFICATE OF CORRECTION

PATENT NO. : 4,848,039

DATED : July 18, 1989

INVENTOR(S) : Kenneth L. Kummer

It is certified that error appears in the above-identified patent and that said Letters Patent is hereby corrected as shown below:

Column 7, line 46, "60'''" should be --60'''--.

Column 8, line 45, "per se" should be --per se--.

Column 8, line 51, insert --.-- before "Each".

Column 8, line 53, insert --.-- before "Suitable".

Column 12, line 15, "location" should be "locations".

Col. 12, lines 26-28, delete ",said movement being effected in a plane perpendicular to the axis of rotation of the grinding wheel", and insert therefor --a peripheral face of--.

Col. 12, line 31, delete "of said plurality of fixtures" and insert therefor --, said movement being effected in a plane perpendicular to the axis of rotation of the grinding wheel--.

Col. 12, line 36, after "remaining fixtures", insert --of said plurality of fixtures--.

Column 12, line 50, after claim 6, insert the following claims:

UNITED STATES PATENT AND TRADEMARK OFFICE

CERTIFICATE OF CORRECTION

PATENT NO. : 4,848,039

DATED : July 18, 1989

INVENTOR(S) : Kenneth L. Kummer

It is certified that error appears in the above-identified patent and that said Letters Patent is hereby corrected as shown below:

--7. The method in accordance with claim 5 in which step (A) includes mounting each said workpiece in a holding fixture that is initially located at a plane that is perpendicular to the rotational axis of said grinding wheel and that passes through the peripheral face of said grinding wheel.--

--8. The method in accordance with claim 5 in which step (B) includes, before moving said fixture in said path, positioning one of said fixtures adjacent said grinding wheel peripheral face at said plane that is perpendicular to the rotational axis of said grinding wheel.--

--9. The method in accordance with claim 8 in which said step of positioning said fixture at said plane includes moving said fixture to said plane.--

--10. The method in accordance with claim 6 in which step (B) includes initially positioning said holding fixtures to locate each workpiece at a plane that is perpendicular to the rotational axis of said grinding wheel and that passes through the peripheral face of said grinding wheel.--

--11. The method in accordance with claim 6 in which step (C) includes, before moving said fixture in said path, positioning one of said fixtures adjacent said grinding wheel peripheral face at said plane that is perpendicular to the rotational axis of said grinding wheel.--

UNITED STATES PATENT AND TRADEMARK OFFICE

CERTIFICATE OF CORRECTION

PATENT NO. : 4,848,039

DATED : July 18, 1989

INVENTOR(S) : Kenneth L. Kummer

It is certified that error appears in the above-identified patent and that said Letters Patent is hereby corrected as shown below:

--12. The method in accordance with claim 11 in which said step of positioning said fixture at said plane includes moving said fixture to said plane.--

Signed and Sealed this

Fourth Day of September, 1990

*Attest:*

HARRY F. MANBECK, JR.

*Attesting Officer*

*Commissioner of Patents and Trademarks*